US006701807B1

(12) United States Patent
Gammon

(10) Patent No.: US 6,701,807 B1
(45) Date of Patent: Mar. 9, 2004

(54) SOCKET WITH OFF-CENTER SLOT

(76) Inventor: Barry Gammon, 295 Boothby Rd., Limington, ME (US) 04049

( * ) Notice: Subject to any disclaimer, the term of this patent is extended or adjusted under 35 U.S.C. 154(b) by 0 days.

(21) Appl. No.: 10/374,239

(22) Filed: Feb. 25, 2003

(51) Int. Cl.[7] ..... B24B 13/02

(52) U.S. Cl. ..... 81/119; 81/124.2; 81/124.6; 81/DIG. 8

(58) Field of Search ..... 81/119, 124.2, 81/124.4, 120, 124.6, DIG. 8

(56) References Cited

U.S. PATENT DOCUMENTS

| | | | | |
|---|---|---|---|---|
| 1,434,401 A | | 11/1922 | Mueller | |
| D160,267 S | | 9/1950 | McCammon et al. | |
| 2,715,347 A | | 8/1955 | Johnson | |
| 4,485,702 A | | 12/1984 | Swan et al. | |
| 5,048,378 A | | 9/1991 | Nikolas | |
| 5,050,463 A | | 9/1991 | Stielow | |
| 5,231,733 A | * | 8/1993 | Dittman | 16/412 |
| 5,537,897 A | | 7/1996 | Wilson, Jr. | |
| 5,542,321 A | | 8/1996 | Fuca | |
| D376,521 S | | 12/1996 | Farnan et al. | |
| H1689 H | | 11/1997 | Foucher | |
| 5,697,268 A | * | 12/1997 | Makovsky et al. | 81/125 |
| 6,112,625 A | | 9/2000 | Turtle | |
| 6,138,533 A | | 10/2000 | Turtle | |
| D433,895 S | * | 11/2000 | Kindel | D8/28 |
| 6,257,099 B1 | | 7/2001 | Rosenbaum | |

* cited by examiner

*Primary Examiner*—Hadi Shakeri
(74) *Attorney, Agent, or Firm*—Chris A. Caseiro; Verrill & Dana, LLP

(57) ABSTRACT

A socket device with an off-center slot for loosening and tightening connectors positioned in confined locations. The socket includes a socket body, a slot to allow a tube or pipe to pass there through and a nut retaining region. The nut retaining region positioned adjacent to a first face of the socket has a centerline that is offset from the centerline of the socket body. A socket driver port located in the opposing second face of the socket has a centerline that is offset from the centerline of the socket body but remains within the dimensions of the socket body. That arrangement allows socket rotation within a confined area with maximum possible mechanical advantage. The socket may have different receiving region configurations to accommodate different nut connector designs.

6 Claims, 10 Drawing Sheets

SOCKET WITH OFF-CENTER SLOT

BACKGROUND OF THE INVENTION

1. Field of the Invention

The present invention relates to sockets. More particularly, the present invention relates to sockets for use in loosening and tightening nuts and washers in difficult to reach locations. Still more particularly, the present invention relates to devices for loosening and tightening nuts and washers used to connect pipes and tubing to basin faucet connections.

2. Description of the Prior Art

In a variety of situations, it is a common problem for individuals seeking to connect or disconnect a coupling to gain access to such a coupling in a manner that enables reasonable loosening or tightening of the coupling. The coupling may be in a remote location or movement may be restricted by the particular surroundings. For example, a fitting associated with an engine may be in an awkward location with little lateral movement possible, or it may be adjacent to other relatively immovable objects. The individual must therefore have a very specialized tool to contact the fitting and rotate it. More often, the individual must use a relatively standard tool, such as a wrench, and go through a series of contortions to access the fitting and rotate it in a limited manner such as by making very short movements and resetting the tool on the fitting.

The situations in which an individual can find himself or herself in need of a specialized tool to gain access to a fitting, coupling or connection may be endless. One such situation that generated the conception of the present invention relates to the connection of supply and return pipes and tubes to the faucet of a basin or sink. That connection comprises one or more coupling nuts that removably join the supply and return pipes/tubes to the faucet mechanism. The connection is ordinarily located on the underside of the basin, where the space is confined and the tubes and pipes restrict the ability to move laterally. That confinement and restriction on lateral movement make difficult the use of a standard open-ended or box-end wrench to loosen or tighten the coupling nut. Moreover, the tube/pipe is substantially aligned on center with the center of the connecting device. That alignment prevents use of any inline device, such as a close-ended socket on a ratchet with extension, because the pipe/tube restricts access as well as rotational movement.

There are several limitations associated with devices that would otherwise be used for loosening and tightening connections in confined areas and with tube/pipe alignment restrictions. One such limitation is having the opening used to contact and retain the connector being centered on the body of the device. A device with an opening that is centered on the device body, such as an open-ended socket, will be adversely restricted by the alignment of the tube or pipe with the connecting nut. Another limitation is having the component of the device used to cause device rotation—such as a socket driver—centered on the body of the device. A device with such a restriction may also be adversely affected by the alignment of the tube or pipe with the connecting nut. Yet another limitation is having the component of the device used to cause rotation positioned adjacent to the body of the device. Placing the driver substantially away from the center of the body significantly reduces the mechanical advantage required to force connector rotation. A further undesired limitation is having a substantially long device body relative to the height of the connector. That limitation may cause binding of the device on the connector under any misalignment condition.

Therefore, what is needed is a device for loosening and tightening connections located in confined spaces. The device must include a body member for retaining the connector and designed to allow its rotation by a rotation-causing element such as a socket driver. The opening of the body member for retaining the connector is preferably not centered on the body. What is also needed is such a device designed to position the component that causes rotation of the body member off center from the center of the body member.

SUMMARY OF THE INVENTION

It is an object of the present invention to provide a socket for loosening and tightening connectors located in confined spaces. It is also an object of the present invention to provide such a socket having a body member with an off-center connector retention space and an off-center port for receiving a socket driver. It is therefore an object of the present invention to enable leveraged movement of a confined connector element with reduced impedance to that element caused by the positioning of tubes or pipes connected therewith.

These and other objects are achieved by the present invention, which is an improved socket. The socket is a socket body having a slot running its length and, in one face, a driver port for receiving a socket driver. The driver port is offset from the centerline of the socket body. The opposing face of the socket body and that portion of the slot adjacent to that face are configured to grab a connector nut to be loosened or tightened. Having a slot through the length of the socket allows a user to comfortably fit the socket around any tubing or piping that terminates in or passes through the nut to be loosened or tightened. Having the driver port off center of the body but still part of the socket body allows the user to comfortably manipulate the socket at a distance and with leverage. The opposing face of the socket may also include face slots spaced to accommodate the wings of a plastic nut should one have to be loosened or tightened.

A single socket body of the present invention may be configured to accept connector nuts of varied sizes. That capability may be achieved by forming a portion of the slotted space of the socket body with a plurality of stepped regions varying in dimensions that comform to the dimensions of connector nut sizes in use. Alternatively, the socket body may be configured with only one nut-retaining space configuration. A plurality of socket bodies each with a different slot space configuration may be assembled in a kit to allow a user to employ separate sockets for differing nut dimensions.

The nut-receiving space is established by forming in the socket body an annulus, the center of which is off the centerline of the socket body. The socket body may be cylindrical or polygonal. A portion of the circumference of the wall of the annulus is removed through the entire length and through the thinner portion of the annulus wall to form a slot therein. The width of the slot is selectable but of a size sufficient to allow a pipe or tube to pass there through. A nut capturing region is established adjacent to a first face of the socket body. The nut capturing region is formed in the thicker portion of the annulus wall adjacent to that first face. The opposing face of the socket body includes a driver port for receiving a socket driver. The driver port is located in the thicker portion of the annulus wall.

The present invention is a socket with an off-center slot at one end thereof and an off-center socket driver port in an opposing end thereof. That design enables the user to loosen and tighten connectors in confined spaces by permitting access and maintaining mechanical leverage. These and other advantages of the invention will become apparent upon review of the following detailed description, the accompanying drawings and the appended claims.

DETAILED DESCRIPTION OF THE PREFERRED EMBODIMENT

Figure 1:
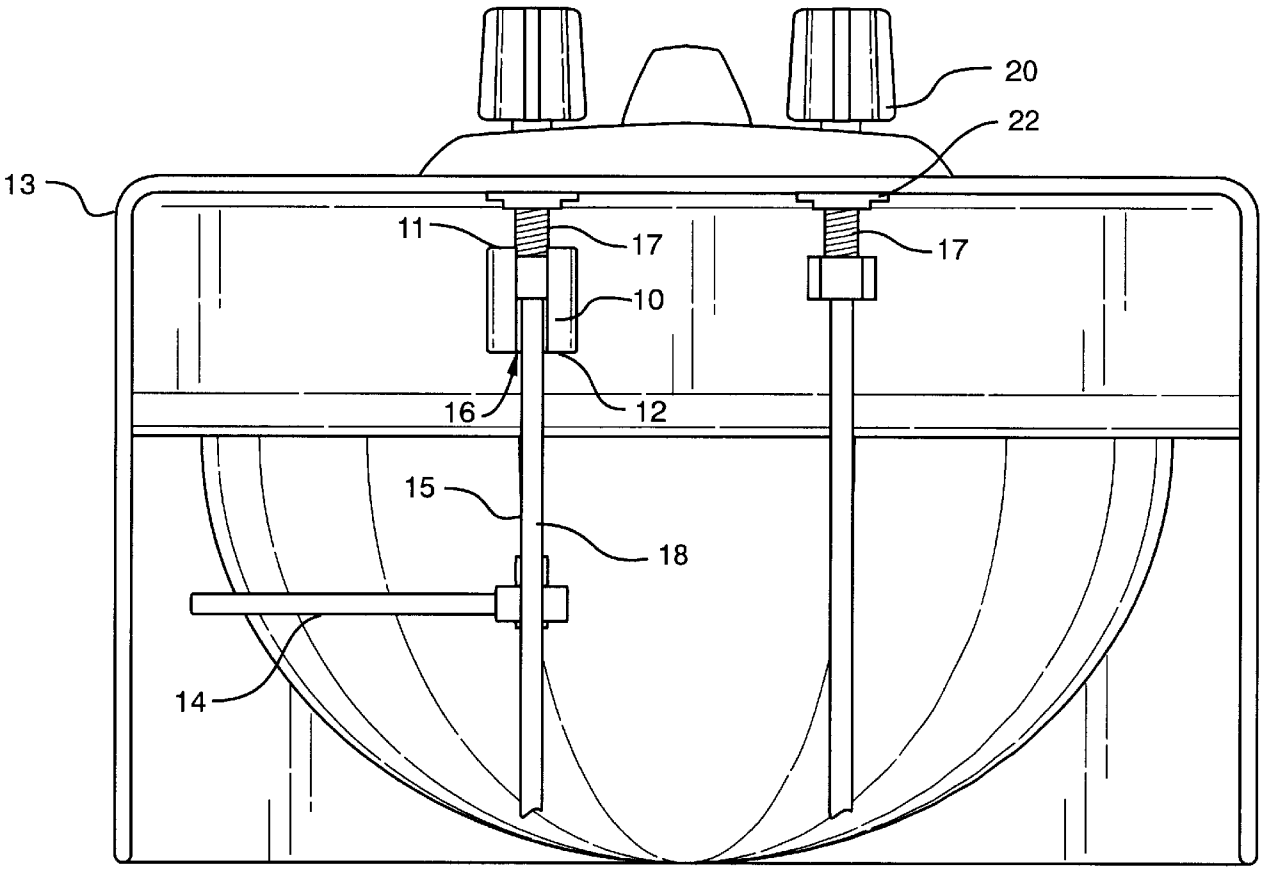
FIG. 1 is a partial cut away view of the underside of a basin showing the socket of the present invention in side view as a device to loosen and tighten the nuts employed to secure faucet stems and supply tubes to the underside of the basin.

As illustrated in FIG. 1, the present invention is an improved socket 10 having a first face 11 and an opposing second face 12. In the figure, the socket 10 is shown in use as a device to loosen and tighten nuts employed to secure supply water to the faucets of a basin. However, it is to be understood that the socket 10 may be employed to loosen and tighten connectors in non-plumbing applications. With continuing reference to FIG. 1, the socket 10 is shown in position on the underside of a basin enclosure 13. The socket 10 may be rotated by a socket driver, such as a ratchet 14. An extension 15 may be used to space the ratchet 14 from the socket 10. The socket 10 includes a socket driver port 16 in the opposing second face 12 for receiving and removably retaining therein the extension 15 or the ratchet 14.

The socket 10 includes a socket body with a receiving slot 17 through the socket body. The receiving slot 17 permits a supply tube 18 to pass there through without inhibiting the interior of the socket body adjacent to the first face 11 from contacting one or more nuts associated with securing the supply tube 18 to a faucet stem 19 of a faucet 20 at the underside of the basin enclosure 13. In particular and as to be described with respect to the other figures, the interior of the socket body is configured to: 1) capture and rotate a supply tube nut 21 associated with securing the supply tube 18 to the faucet stem 19; 2) capture and rotate a faucet stem retaining nut 22 associated with securing the faucet 20 to the underside of the basin enclosure 13; or 3) a combination of the two. Thus, the socket 10 may be employed to cause rotation of the faucet stem retaining nut 22 and/or the supply tube nut 21 without interference from the supply tube 18 and within the confined space associated with an area such as the basin enclosure 13. The arrangement of the interior of the socket 10 including the receiving slot 17 and the position of the socket driver port 16 as described herein enable that capability.

Figure 2:
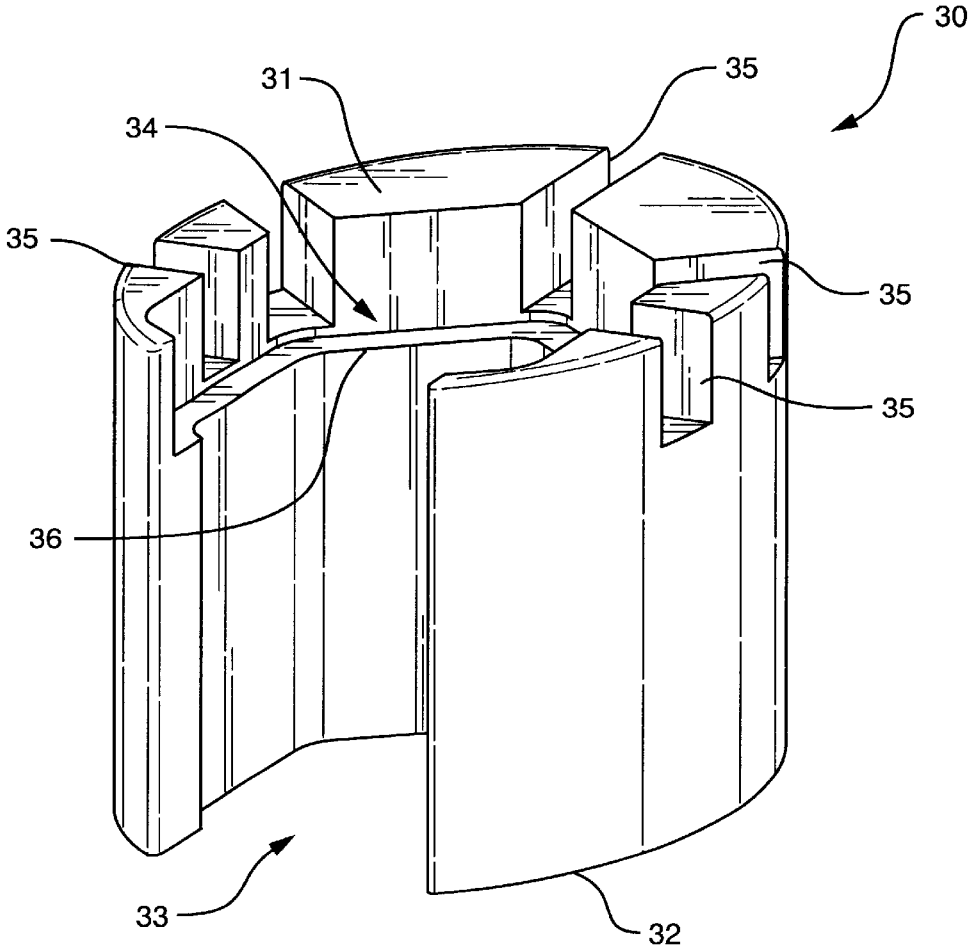
FIG. 2 is a perspective view of a first embodiment of the socket of the present invention.
Figure 3:
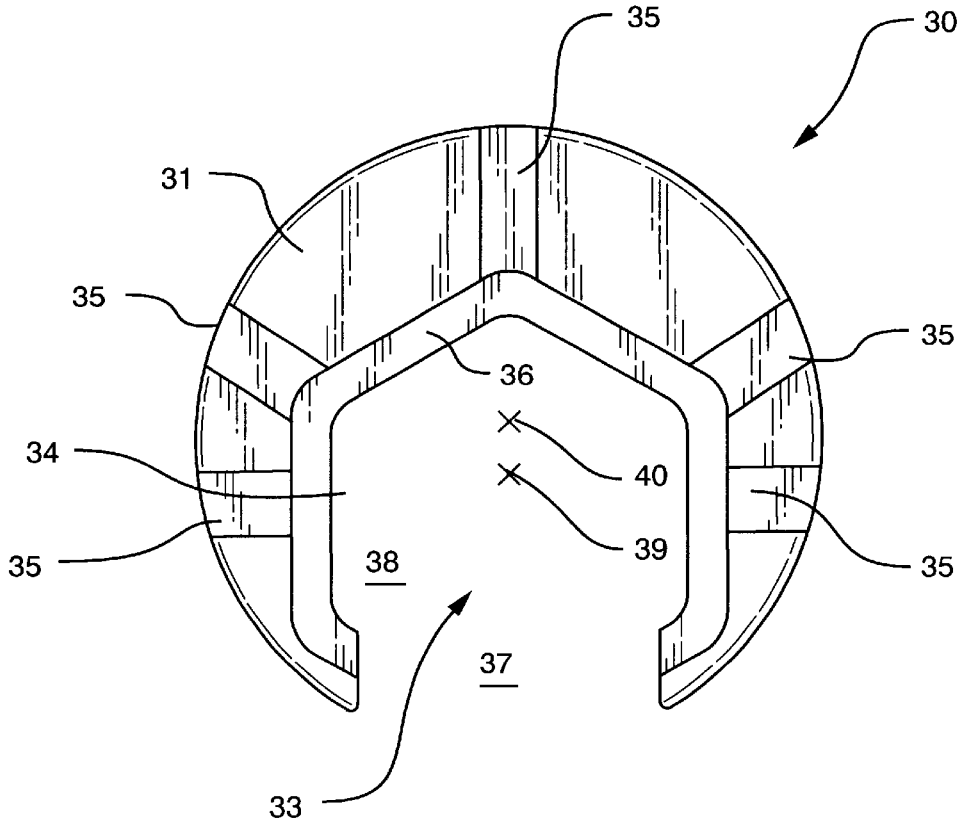
FIG. 3 is a top view of the first embodiment of the socket of the present invention as shown FIG. 2.

As illustrated in FIGS. 2 and 3, a first embodiment of a socket 30 of the present invention includes first face 31, an opposing second face 32, a receiving slot 33, a receiving region 34 for receiving and capturing therein a nut to be loosened or tightened, and a plurality of wing slots 35. The opposing second face 32 includes a socket driver port that is designed substantially the same way for all of the socket embodiments described with respect to FIGS. 2–3 and 5–10, and will be described with reference to FIG. 4. The receiving slot 33 extends from the first face 31 through to the second face 32. It includes an entry 37 through which a supply tube may pass when setting the socket 30 in position, and a tube positioning region 38 in which the tube remains while the socket 30 is being rotated. Of course, the socket 30 may be rotated without a tube in place under the basin. For example, when only the faucet stem retention nut 22 is being rotated.

With continuing reference to FIGS. 2 and 3, the receiving region 34 is adjacent to the first face 31 of the socket 30 and includes a step 36 that acts as a stop against which the face of the nut rests during socket rotation. The receiving region 34 is configured in a polygonal configuration for retaining therein nuts of polygonal shape. The receiving region 34 includes a receiving region centerline 39 that is offset from a socket body centerline 40. In that way, the nut may be retained in the receiving region 34 while the socket driver port remains within the dimensions of the socket body. That ensures maximum mechanical advantage when using the socket 30 without compromising device flexibility in confined spaces. In effect, the socket 30 is an offset annulus, with the relatively thinner portion of the wall of the socket body being the location for the receiving slot 33 and the receiving region 34.

In the embodiment of the present invention shown in FIGS. 2 and 3, the first face 31 includes the plurality of wing slots 35 for retaining therein the wings of a nut that may be a plastic faucet stem retention nut of the type having wings for ease of rotation. A multipurpose version of the socket of the present invention would include such wing slots 35 in the event the user must loosen or tighten such plastic nuts. Alternatively, a version of the socket as shown herein does not include such wing slots 35.

Figure 4:
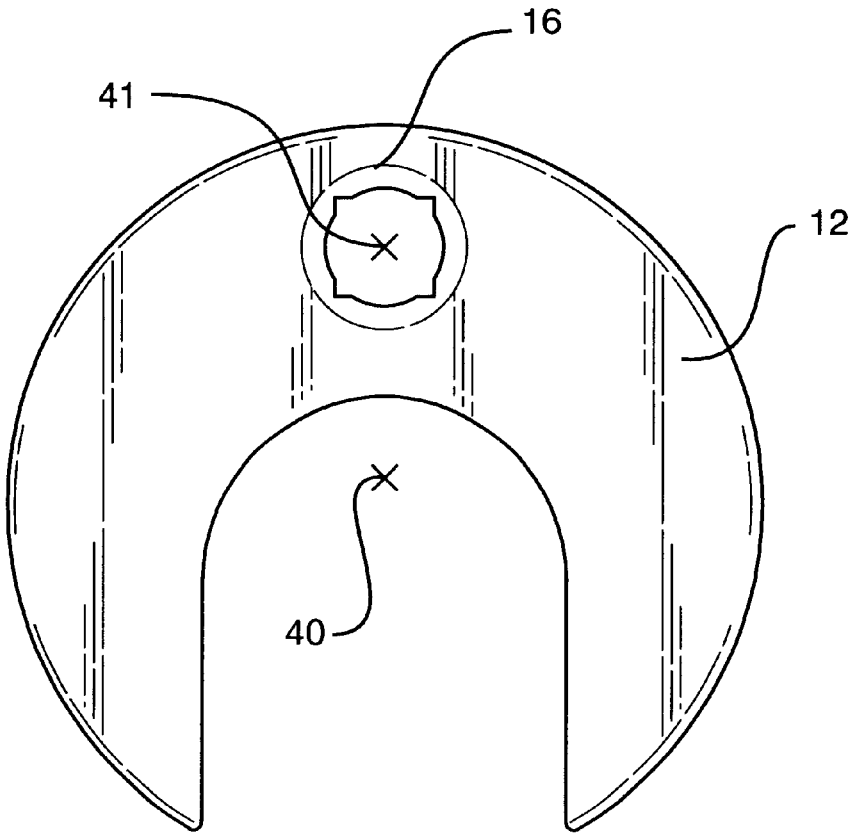
FIG. 4 is a bottom view of the socket of the present invention showing the off-driver center socket driver port.

As illustrated in FIG. 4, the opposing second face 12 includes the socket driver port 16 for receiving a socket driver or other device suitable for causing rotation of any of the opposing face socket configurations of the present invention. The port 16 includes a port centerline 41 that is offline from the socket body centerline 40. That positioning permits formation and positioning of the slot 17 for retaining a supply tube and for location of the nut receiving region without placing the socket driver port 16 outside of the dimensions or footprint of the socket body itself. That allows nut retention within the socket body without reducing significantly the mechanical advantage otherwise achieved by positioning the rotational device directly inline with the socket body centerline 40. Prior socketed wrench devices having the rotational component outside of the dimensions or footprint of the socket suffer loss of rotational leverage.

Figure 5:
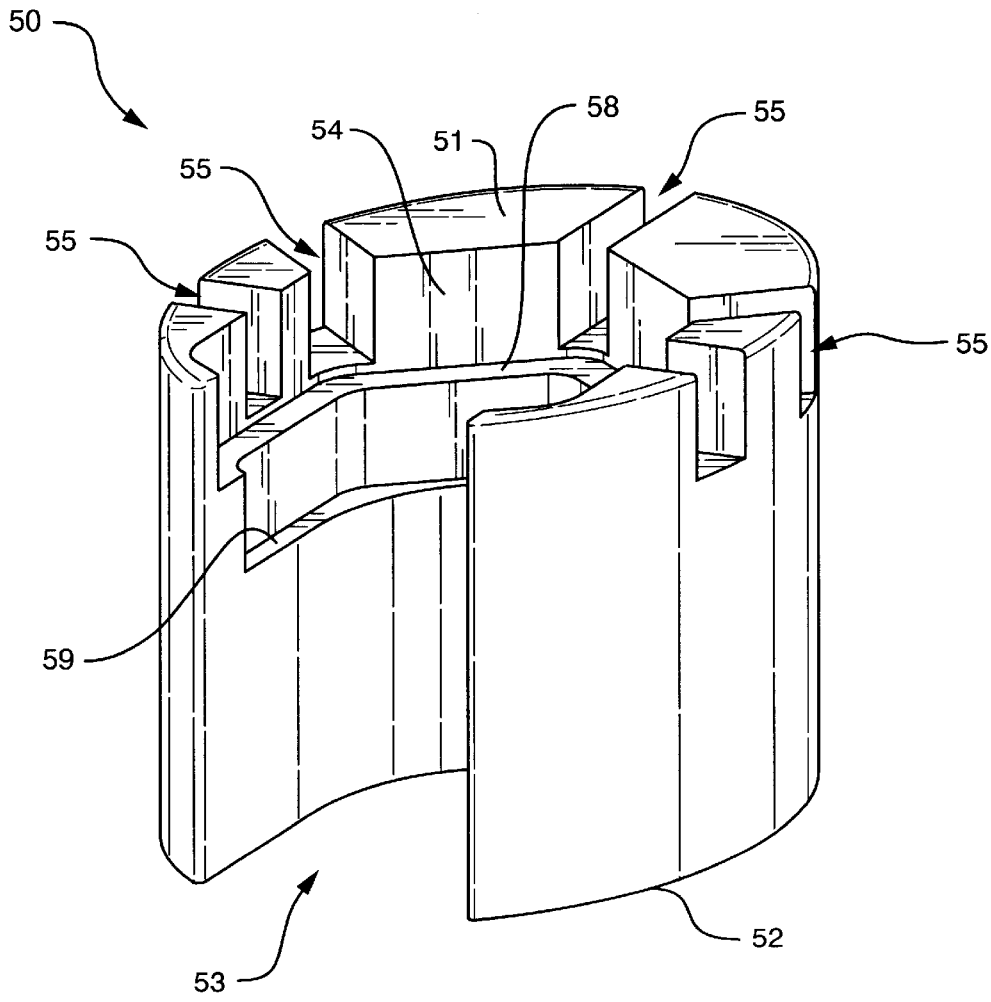
FIG. 5 is a perspective view of a second embodiment of the socket of the present invention.
Figure 6:
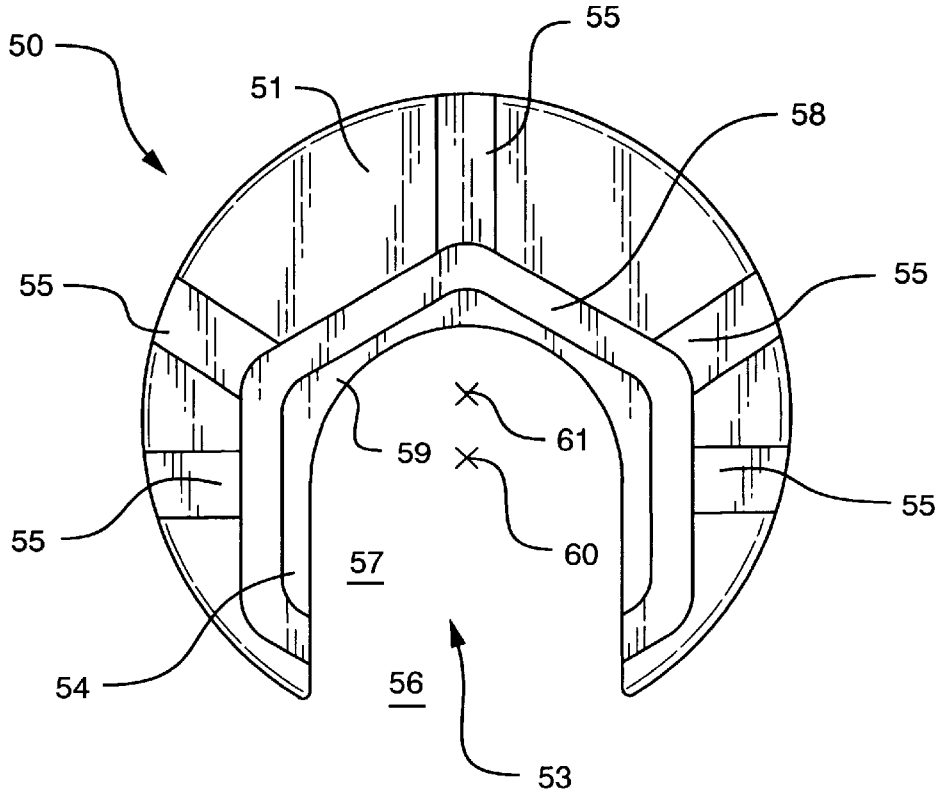
FIG. 6 is a top view of the second embodiment of the socket of the present invention as shown in FIG. 5.

As illustrated in FIGS. 5 and 6, a second embodiment of a socket 50 of the present invention includes first face 51, an opposing second face 52, a receiving slot 53, a receiving region 54 for receiving and capturing therein a nut to be loosened or tightened, and a plurality of wing slots 55. The opposing second face 52 includes a socket driver port that is designed substantially the same way as illustrated in FIG. 4. The receiving slot 53 extends from the first face 51 through to the second face 52. It includes an entry 56 through which a supply tube may pass when setting the socket 50 in position, and a tube positioning region 57 in which the tube remains while the socket 50 is being rotated. Of course, the socket 50 may be rotated without a tube in place under the basin. For example, when only the faucet stem retention nut 22 is being rotated.

With continuing reference to FIGS. 5 and 6, the receiving region 54 is adjacent to the first face 51 of the socket 50 and includes a first step 58 that acts as a stop against which the face of a nut of first dimensions rests during socket rotation. The receiving region 54 includes a second step 59 that acts as a stop against which the face of a nut of second dimensions smaller than the dimensions of the nut associated with the first step 58 rests during socket rotation. In this way, the socket 50 alone may be employed to loosen or tighten a plurality of nuts of differing dimensions. Of course, additional steps may be added if additional nut dimensions are to be covered. The receiving region 54 is configured in a polygonal configuration for retaining therein nuts of polygonal shape. Alternatively, the first step 58 may be of a rounded configuration to retain thereon the head of a rounded plastic nut having wings. The receiving region 54 includes a receiving region centerline 60 that is offset from a socket body centerline 61. In that way, the nut may be retained in the receiving region 54 while the socket driver port remains within the dimensions of the socket body. That ensures maximum mechanical advantage when using the socket 50 without compromising device flexibility in confined spaces. In effect, the socket 50 is an offset annulus, with the relatively thinner portion of the wall of the socket body being the location for the receiving slot 53 and the receiving region 54.

In the embodiment of the present invention shown in FIGS. 5 and 6, the first face 51 includes the plurality of wing slots 55 for retaining therein the wings of a nut that may be a plastic faucet stem retention nut of the type having wings for ease of rotation. A multipurpose version of the socket of the present invention would include such wing slots 55 in the event the user must loosen or tighten such plastic nuts. Alternatively, a version of the socket as shown herein does not include such wing slots 55.

Figure 7:
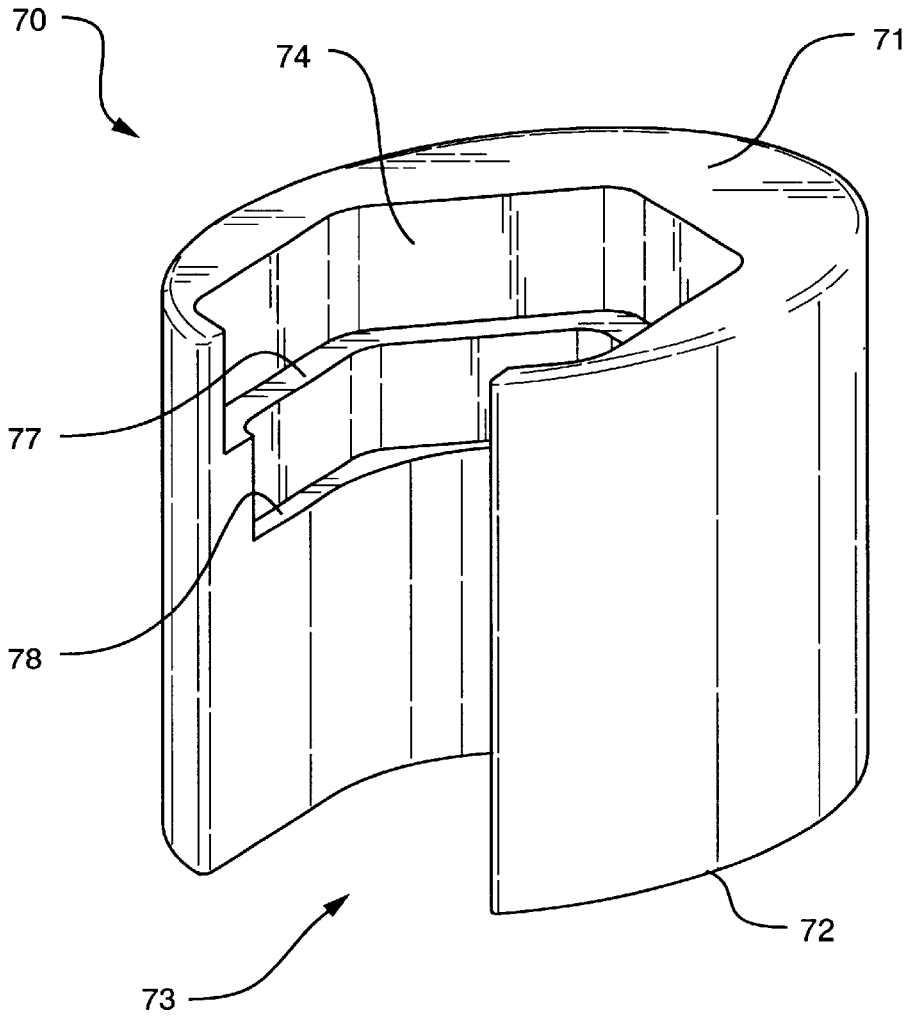
FIG. 7 is a perspective view of a third embodiment of the socket of the present invention.
Figure 8:
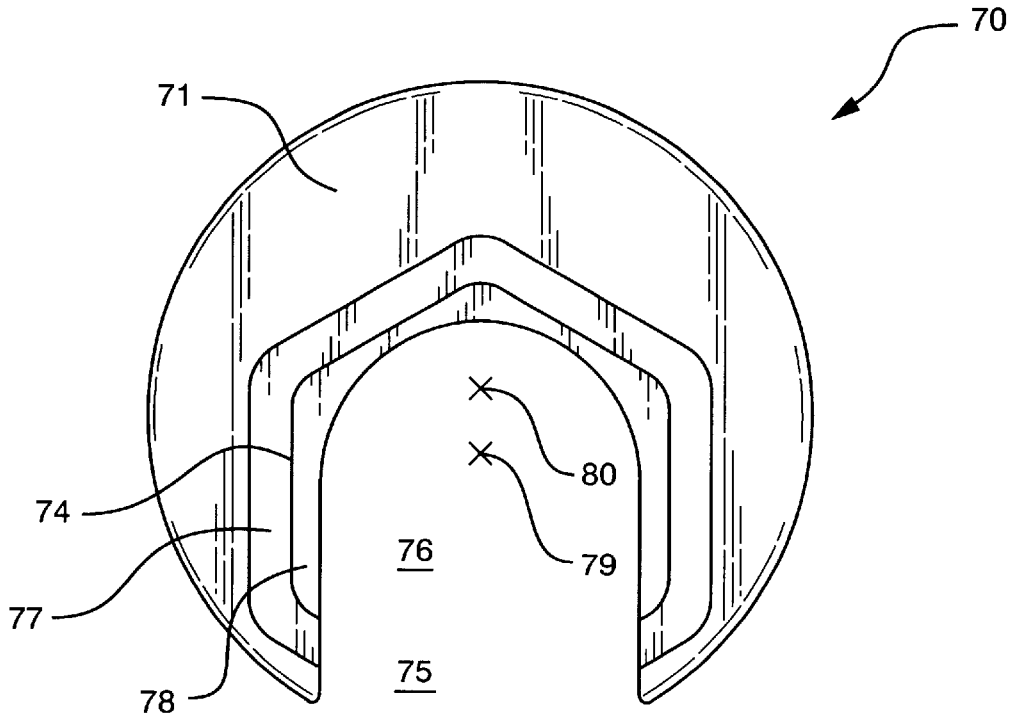
FIG. 8 is a top view of the third embodiment of the socket of the present invention as shown in FIG. 7.

As illustrated in FIGS. 7 and 8, a third embodiment of a socket 70 of the present invention includes first face 71, an opposing second face 72, a receiving slot 73 and a receiving region 74 for receiving and capturing therein a nut to be loosened or tightened. The opposing second face 72 includes a socket driver port that is designed substantially the same way as illustrated in FIG. 4. The receiving slot 73 extends from the first face 71 through to the second face 72. It includes an entry 75 through which a supply tube may pass when setting the socket 70 in position, and a tube positioning region 76 in which the tube remains while the socket 70 is being rotated. Of course, the socket 70 may be rotated without a tube in place under the basin. For example, when only the faucet stem retention nut 22 is being rotated.

With continuing reference to FIGS. 7 and 8, the receiving region 74 is adjacent to the first face 71 of the socket 70 and includes a first step 77 that acts as a stop against which the face of a nut of first dimensions rests during socket rotation. The receiving region 74 includes a second step 78 that acts as a stop against which the face of a nut of second dimensions smaller than the dimensions of the nut associated with the first step 77 rests during socket rotation. In this way, the socket 70 alone may be employed to loosen or tighten a plurality of nuts of differing dimensions. Of course, additional steps may be added if additional nut dimensions are to be covered. The receiving region 74 is configured in a polygonal configuration for retaining therein nuts of polygonal shape. The receiving region 74 includes a receiving region centerline 79 that is offset from a socket body centerline 80. In that way, the nut may be retained in the receiving region 74 while the socket driver port remains within the dimensions of the socket body. That ensures maximum mechanical advantage when using the socket 70 without compromising device flexibility in confined spaces. In effect, the socket 70 is an offset annulus, with the relatively thinner portion of the wall of the socket body being the location for the receiving slot 73 and the receiving region 74.

Figure 9:
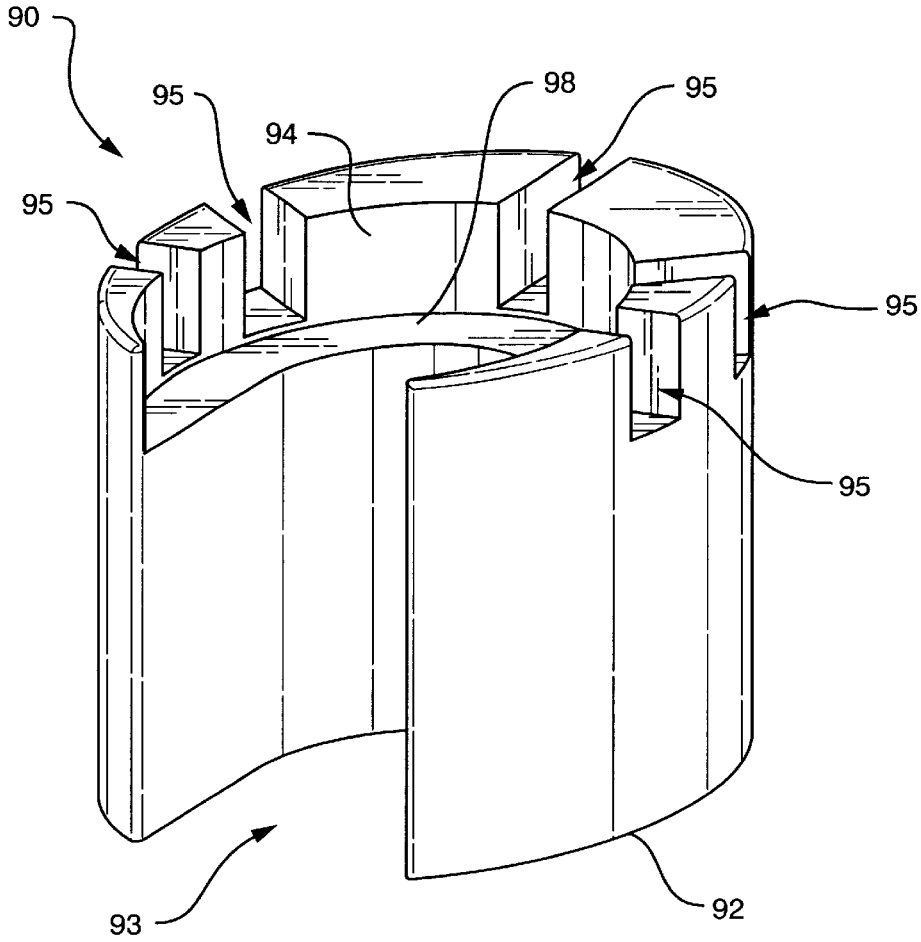
FIG. 9 is a perspective view of a fourth embodiment of the socket of the present invention.
Figure 10:
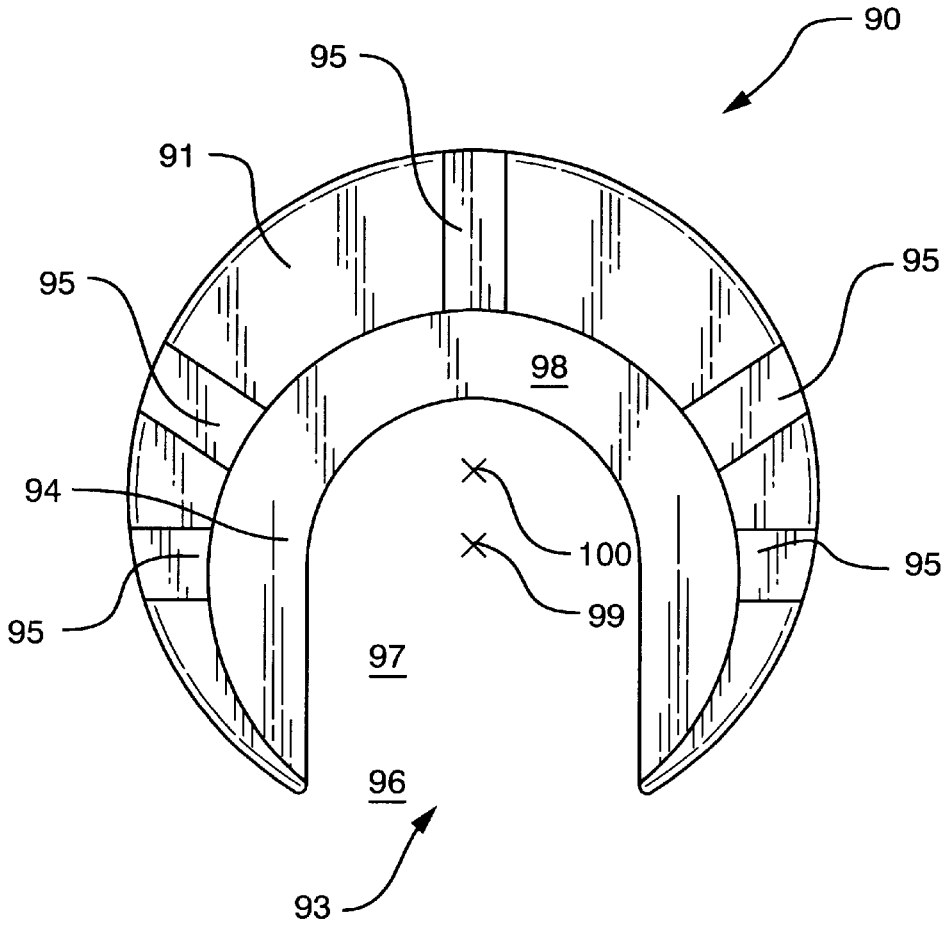
FIG. 10 is a top view of the fourth embodiment of the socket of the present invention as shown in FIG. 9.

As illustrated in FIGS. 9 and 10, a fourth embodiment of a socket 90 of the present invention includes first face 91, an opposing second face 92, a receiving slot 93, a receiving region 94 for receiving and capturing therein a nut to be loosened or tightened, and a plurality of wing slots 95. The opposing second face 92 includes a socket driver port that is designed substantially as described with respect to FIG. 4. The receiving slot 93 extends from the first face 91 through to the second face 92. It includes an entry 96 through which a supply tube may pass when setting the socket 90 in position, and a tube positioning region 97 in which the tube remains while the socket 90 is being rotated. Of course, the socket 90 may be rotated without a tube in place under the basin. For example, when only the faucet stem retention nut 22 is being rotated.

With continuing reference to FIGS. 9 and 10, the receiving region 94 is adjacent to the first face 91 of the socket 90 and includes a step 98 that acts as a stop against which the face of the nut rests during socket rotation. The receiving region 94 is configured in a rounded configuration for retaining therein nuts of rounded head shape—including, but not limited to, plastic nuts with rounded heads. The receiving region 94 includes a receiving region centerline 99 that is offset from a socket body centerline 100. In that way, the nut may be retained in the receiving region 94 while the socket driver port remains within the dimensions of the socket body. That ensures maximum mechanical advantage when using the socket 90 without compromising device flexibility in confined spaces. In effect, the socket 90 is an offset annulus, with the relatively thinner portion of the wall of the socket body being the location for the receiving slot 93 and the receiving region 94.

In the embodiment of the present invention shown in FIGS. 9 and 10, the first face 91 includes the plurality of wing slots 95 for retaining therein the wings of a nut that may be a plastic faucet stem retention nut of the type having wings for ease of rotation. A multipurpose version of the socket of the present invention would include such wing slots 95 in the event the user must loosen or tighten such plastic nuts. Alternatively, a version of the socket as shown herein does not include such wing slots 95.

While the present invention has been described with particular reference to certain embodiments of the socket, it is to be understood that it includes all reasonable equivalents thereof as defined by the following appended claims.

What is claimed is:

1. A socket for rotatably loosening or tightening a connection element, the socket comprising a cylindrical socket body having a centerline, a first face and an opposing second face, wherein a receiving slot having a centerline not in alignment with the centerline of the socket body is formed in the socket body and extends from the first face to the second face, wherein the receiving slot includes a receiving region adjacent to the first face for receiving the connection element, the receiving region including a step against which the connection element rests during rotation of the socket body and wherein the second face includes a socket driver port therein that does not extend through to the first face of the socket body, the socket driver port having a centerline that is not in alignment with the centerline of the socket body, and wherein the port is position within a radius defining the centerline of said cylindrical socket body.

2. The socket as claimed in claim 1 wherein the receiving region of the receiving slot is of a polygonal configuration.

3. The socket as claimed in claim 1 wherein the receiving region of the receiving slot includes a plurality of stepped polygonal configurations.

4. The socket as claimed in claim 1 wherein the connection element is a nut with wings, said first face of the socket body including a plurality of wing slots for receiving and retaining the wings therein.

5. The socket as claimed in claim 4 wherein the receiving region is of a rounded configuration.

6. The socket as claimed in claim 4 wherein the receiving region is of a polygonal configuration.

* * * * *